US009612554B2

(12) United States Patent
Sakamoto et al.

(10) Patent No.: US 9,612,554 B2
(45) Date of Patent: Apr. 4, 2017

(54) LIQUID DEVELOPMENT DEVICE AND IMAGE-FORMING APPARATUS

(71) Applicant: FUJI XEROX CO., LTD., Tokyo (JP)

(72) Inventors: Tokuya Sakamoto, Kanagawa (JP); Wataru Suzuki, Kanagawa (JP); Taichi Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/046,088

(22) Filed: Feb. 17, 2016

(65) Prior Publication Data

US 2016/0161886 A1 Jun. 9, 2016

Related U.S. Application Data

(63) Continuation of application No. 14/482,528, filed on Sep. 10, 2014.

(30) Foreign Application Priority Data

Mar. 18, 2014 (JP) ..... 2014-055497

(51) Int. Cl.
*G03G 15/10* (2006.01)
*G03G 15/11* (2006.01)

(52) U.S. Cl.
CPC ..... *G03G 15/11* (2013.01); *G03G 15/10* (2013.01); *G03G 15/104* (2013.01); *G03G 15/105* (2013.01)

(58) Field of Classification Search
CPC ..... G03G 15/11; G03G 15/104; G03G 15/10; G03G 15/105
USPC ..... 399/237
See application file for complete search history.

(56) References Cited

U.S. PATENT DOCUMENTS

| | | | | |
|---|---|---|---|---|
| 4,860,050 | A * | 8/1989 | Kurotori | G03G 15/104 399/238 |
| 5,345,296 | A * | 9/1994 | Wellings | G03G 15/104 106/31.6 |
| 6,308,034 | B1 * | 10/2001 | Nakashima | G03G 15/105 399/249 |
| 2003/0016962 | A1 * | 1/2003 | Teraoka | G03G 15/104 399/57 |

(Continued)

FOREIGN PATENT DOCUMENTS

| | | | |
|---|---|---|---|
| JP | 2001-296747 | A | 10/2001 |
| JP | 2001296747 | A * | 10/2001 |
| JP | 2009-008726 | A | 1/2009 |

*Primary Examiner* — David Gray
*Assistant Examiner* — Tyler Hardman
(74) *Attorney, Agent, or Firm* — Oliff PLC

(57) ABSTRACT

A liquid development device includes a storage section storing a liquid developer in which toner is dispersed, a development member to which the liquid developer stored in the storage section is applied using an application unit, a removing device that, after an electrostatic latent image in a latent image-holding member is developed, removes the liquid developer remaining on the development member, and a shearing device that is provided in a path through which the liquid developer removed using the removing device is returned to the storage section, and applies a shear force to the liquid developer removed using the removing device by making the liquid developer pass through a contact section of two members at least one of which rotates and that have different velocities from each other.

6 Claims, 5 Drawing Sheets

(56) References Cited

U.S. PATENT DOCUMENTS

2006/0104667 A1* 5/2006 Saito ..... G03G 15/104
399/239

* cited by examiner

LIQUID DEVELOPMENT DEVICE AND IMAGE-FORMING APPARATUS

CROSS-REFERENCE TO RELATED APPLICATIONS

This application is a continuation application of U.S. application Ser. No. 14/482,528 filed Sep. 10, 2014, incorporated herein by reference in its entirety, and claims priority under 35 U.S.C. 119 from Japanese Patent Application No. 2014-055497 filed Mar. 18, 2014.

BACKGROUND

Technical Field

The present invention relates to a liquid development device and an image-forming apparatus.

SUMMARY

According to an aspect of the invention, there is provided a liquid development device including:

a storage section storing a liquid developer in which toner is dispersed;

a development member to which the liquid developer stored in the storage section is applied using an application unit;

a removing device that, after an electrostatic latent image in a latent image-holding member is developed, removes the liquid developer remaining in the development member; and a shearing device that is provided in a path through which the liquid developer removed using the removing device is returned to the storage section, and applies a shear force to the liquid developer by making the liquid developer pass through a contact section of two members either or both of which rotate and that have different circumferential velocities from each other.

BRIEF DESCRIPTION OF THE DRAWINGS

Exemplary embodiments of the present invention will be described in detail based on the following figures, wherein.

DETAILED DESCRIPTION

An example of an image-forming apparatus of an exemplary embodiment of the invention will be described.

Overall Configuration of Image-Forming Apparatus

First, the overall configuration of the image-forming apparatus according to the exemplary embodiment of the invention will be described.

Figure 5:
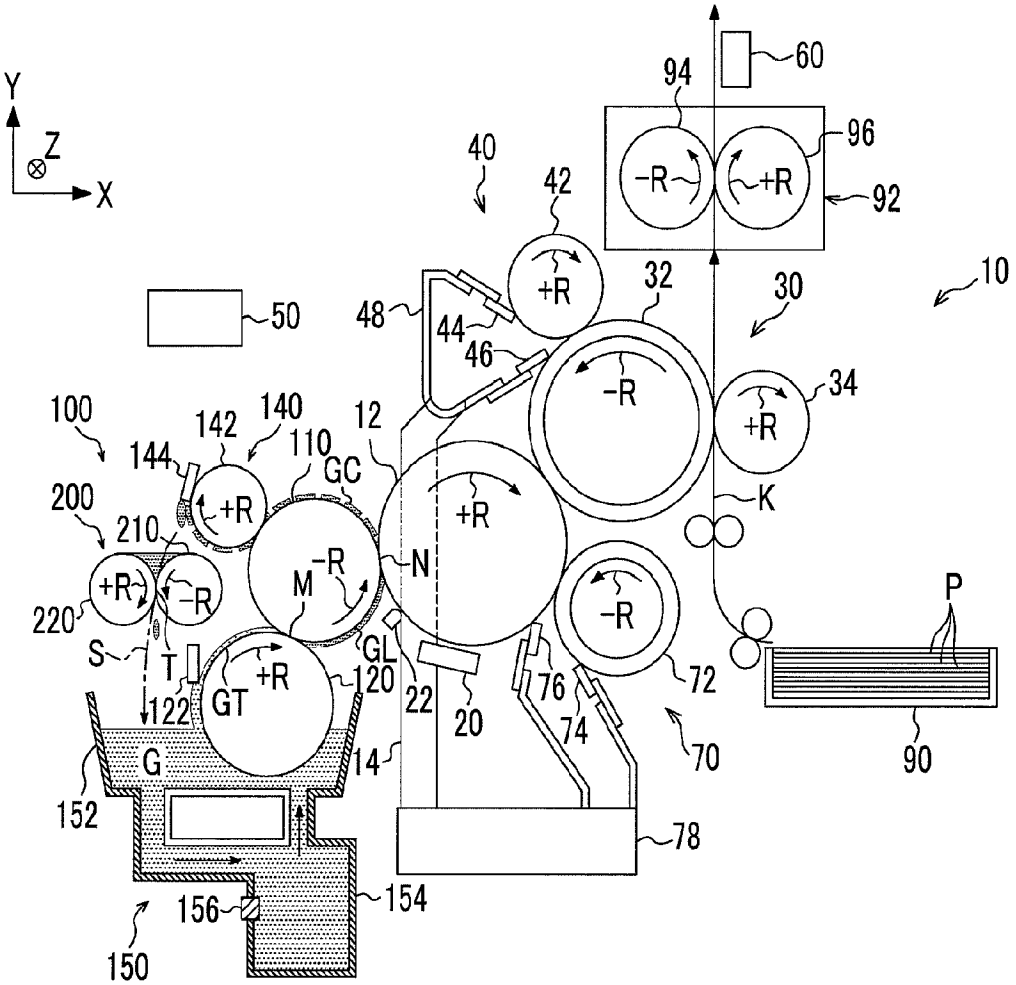
FIG. 5 is a brief configuration view schematically showing an image-forming apparatus according to an exemplary embodiment of the invention.

As shown in FIG. 5, an image-forming apparatus 10 according to an exemplary embodiment of the invention includes a drum-shaped photoreceptor 12 as an example of an image-holding member. The photoreceptor 12 is rotated in a +R direction using a driving unit, not shown, with the Z direction as a rotation axis direction. Around the photoreceptor 12, a charging machine 20, an exposure device 22, a liquid development device 100, a transfer device 30 as an example of a transfer unit, a cleaner for the photoreceptor 70, and the like are disposed.

In the present exemplary embodiment, a scorotron charging machine is used as the charging machine 20, and the surface of the photoreceptor 12 is charged through corona discharge.

In the exemplary embodiment, an LED exposure device is used as the exposure device 22, and the exposure device exposes the photoreceptor 12 charged using the charging machine 20 based on image information, and forms an electrostatic latent image on the surface of the photoreceptor 12. Meanwhile, the exposure device 22 may be an exposure device other than the LED exposure device, and may be, for example, an exposure device that uses a laser light ray for exposure.

The liquid development device 100 develops (visualizes) the electrostatic latent image formed on the photoreceptor 12 using a liquid developer G, and forms a toner image on the surface of the photoreceptor 12. Meanwhile, the liquid development device 100 will be described below in detail.

As the liquid developer G, a liquid obtained by dispersing toner (particles) in a carrier liquid (solvent) is used. As the carrier liquid, for example, an insulating liquid such as vegetable oil, liquid paraffin, or silicone oil is used. As an example, toner (particles) having an average particle diameter in a range of 0.5 μm to 5 μm is dispersed in the carrier liquid in a concentration in a range of 15% by weight to 35% by weight. In addition, a charge-controlling agent or a dispersant may be added to the liquid developer G.

The cleaner for the photoreceptor 70 includes a first waste toner tank 78 and a cleaning roll 72 that contacts the photoreceptor 12. Furthermore, the cleaner for the photoreceptor 70 includes urethane rubber cleaning blades 74 and 76. The cleaning blade 76 contacts the photoreceptor 12, and the cleaning blade 74 contacts the cleaning roll 72, thereby removing the liquid developer G respectively. The removed liquid developer G is collected to the first waste toner tank 78.

As the transfer device 30, an intermediate transfer-type transfer device including a drum-shaped intermediate transfer member 32 to which the toner image formed on the surface of the photoreceptor 12 is transferred, an intermediate transfer member cleaner 40, and a transfer roll 34 that transfers the toner image that has been transferred to the surface of the intermediate transfer member 32 to a recording medium P is used. In addition, the toner image formed on the photoreceptor 12 is transferred to the recording medium P using the transfer roll 34 through the intermediate transfer member 32 in the transfer device 30.

Meanwhile, the transfer device 30 may have a configuration other than the above-described configuration. For example, the transfer device may have a configuration provided with a belt-shaped intermediate transfer member, or may be a direct transfer-type transfer device that does not include the intermediate transfer member and the intermediate transfer member cleaner, and directly trans fers the toner image to the recording medium P from the photoreceptor 12 using the transfer roll 34.

The intermediate transfer member cleaner 40 includes a second waste toner tank 48 and a cleaning roll 42 that contacts the intermediate transfer member 32. Furthermore, the intermediate transfer member cleaner 40 includes urethane rubber cleaning blades 44 and 46. The cleaning blade 46 contacts the intermediate transfer member 32, and the cleaning blade 44 contacts the cleaning roll 42, thereby removing the liquid developer G respectively. The removed liquid developer G is collected to the second waste toner tank 48. The liquid developer G collected to the second waste toner tank 48 is sent to the first waste toner tank 78 through a pipe 14.

Meanwhile, in the exemplary embodiment, as both the cleaning roll for intermediate transfer 42 and the cleaning roll 72 for the photoreceptor, roll members obtained by coating the surface of a SUS core or the like with oil-proof rubber such as NBR or ECO are used, and the rubber layer thickness is set, for example, in a range of 5 mm to 20 mm.

In addition, a housing section 90 housing the sheet-shaped recording medium P such as recording paper is provided at the lower part of the image-forming apparatus 10, and the recording medium P is fed along a feeding path K.

The image-forming apparatus 10 includes a fixing device 92 as an example of a fixing unit that fixes the toner image to the recording medium P to which the toner image has been transferred. In the exemplary embodiment, the fixing device 92 includes a heating roll 94 as an example of a heating member and a pressurizing roll 96 as an example of a pressurizing member that is opposite to the heating roll 94 and presses the heating roll. In addition, the toner image is fixed to the recording medium P using heat and pressure by passing the recording medium P to which the toner image has been transferred between the heating roll 94 and the pressurizing roll 96 in the fixing device 92. Meanwhile, the fixing method in the fixing device 92 may be, for example, contact heat fixing using a belt member or non-contact heat fixing using an oven, a flash lamp, or the like instead of using the heating roll 94 and the pressurizing roll 96.

The image-forming apparatus 10 includes a scanner 60 that scans the toner image on the recording medium P after fixing. In addition, the image-forming apparatus 10 includes a control section 50. The control section 50 carries out a variety of controls of the entire image-forming apparatus 10.

Formation of Image

Next, the formation of an image will be described. Meanwhile, the respective rolls are configured to be rotated in a direction indicated by an arrow +R or an arrow −R using a driving device, not shown, or driven rotation.

The surface of the photoreceptor 12 is charged using the charging machine 20, and an electrostatic latent image based on the image information is formed on the surface of the photoreceptor 12 using the exposure device 22. The electrostatic latent image is developed using the liquid development device 100, and a toner image is formed on the surface of the photoreceptor 12. The toner image formed on the photoreceptor 12 is primarily transferred to the surface of the intermediate transfer member 32 when a bias voltage is applied to a core in the intermediate transfer member 32. The primarily-transferred toner image is secondarily transferred to the recording medium P due to a bias voltage applied to the transfer roll 34. The recording medium P to which the toner image has been transferred is fed to the fixing device 92, and the toner image is fixed to the recording medium P. The recording medium P to which the toner image is fixed is discharged to a discharging section, not shown, after the toner image is scanned using the scanner 60.

Meanwhile, the liquid developer G that has not been primarily transferred to the intermediate transfer member 32 and remains on the photoreceptor 12 is removed using the cleaner for the photoreceptor 70. In addition, the liquid developer G that has not been secondarily transferred to the recording medium P and remains on the intermediate transfer member 32 is removed using the cleaner for the intermediate transfer member cleaner 40.

Meanwhile, when a bias voltage is applied to the core in the cleaning roll for intermediate transfer 42 and the cleaning roll 72 for the photoreceptor, principally the toner in the residual liquid developer G is attached to the cleaning rolls 42 and 72 respectively, and is removed. In addition, after that, principally the carrier liquid is removed using the cleaning blade for intermediate transfer 46 and the cleaning blade 76 for the photoreceptor. Since the above-described configuration enables the effective suppression of the remaining of the toner in the intermediate transfer member 32 and the photoreceptor 12, for example, the occurrence of an image defect such as fogging caused by the remaining toner in the intermediate transfer member 32 and the photoreceptor 12 is effectively prevented or suppressed. Development device of the exemplary embodiment Next, the liquid development device 100 of an exemplary embodiment to which the invention is applied will be described in detail.

Figure 1:
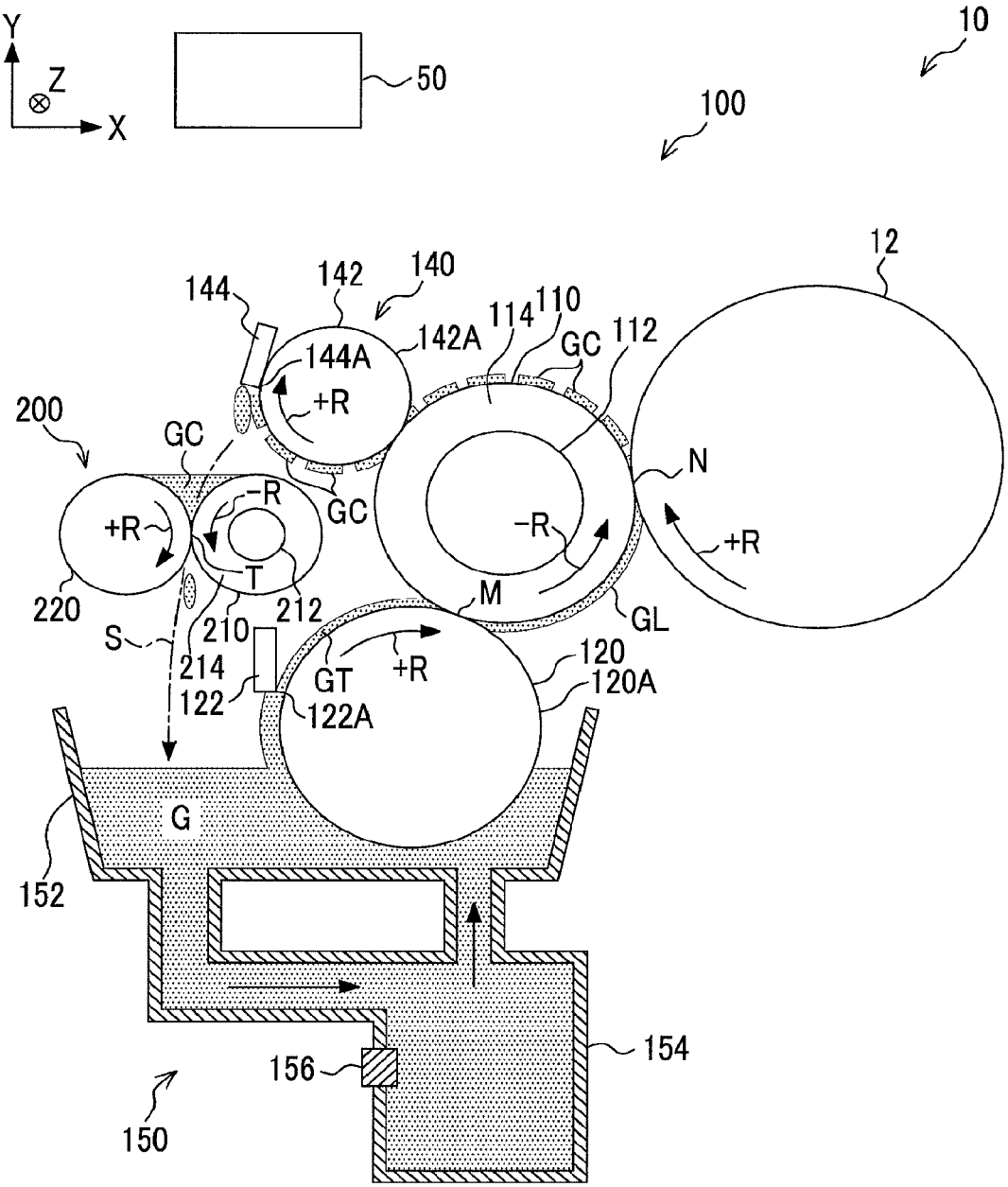
FIG. 1 is a brief configuration view schematically showing a development device according to an exemplary embodiment of the invention.

As shown in FIG. 1, the liquid development device 100 of the exemplary embodiment includes a development roll 110 as an example of the development member and an application roll (anilox roll) 120 as an example of an application unit. In addition, the liquid development device 100 includes a storage section 150 storing the liquid developer G, a removing device 140 that removes the residual liquid developer GC remaining on the development roll 110, and a shearing device 200 that applies a shear force to the residual liquid developer GC removed using the removing device 140.

The storage section 150 includes a storage tank 152 and a concentration control tank 154. The liquid developer G is stored in the storage tank 152. In addition, a stirring screw (not shown) that stirs the liquid developer G is provided in the storage tank 152.

The concentration control tank 154 is configured so that the liquid developer G is circulated between the concentration control tank and the storage tank 152. A concentration sensor 156 that measures the concentration of the toner in the liquid developer G is provided in the concentration control tank 154. In addition, a carrier liquid tank that complements the carrier liquid (solvent), not shown, a complementary tank in which the toner (particles) is dispersed in a high concentration, and the like are connected to the concentration control tank 154. In addition, a control section 50 is configured to appropriately replenish the carrier liquid in the carrier liquid tank, not shown, and a complementary liquid in the complementary liquid tank based on the measurement result in a concentration sensor 156 so that the concentration of the toner falls within a predetermined range.

A rotating body having the Z direction as the rotation axis direction is used as the application roll (anilox roll) 120 that is an example of the application unit, the bottom end section is immersed in the liquid developer G in the storage tank 152, and a section that is not immersed in the liquid developer G is in contact with the development roll 110.

A diagonal-patterned groove (engraved groove) is formed on an outer circumferential surface 120A of the application roll 120. The shape of the groove formed on the outer circumferential surface 120A of the application roll 120 may have a pyramid pattern, a lattice pattern, or the like in addition to the diagonal pattern. The application roll 120 is rotated in the +R direction using the driving unit, not shown, and the application roll lifts and holds the liquid developer G from the storage tank 152.

A regulatory blade 122 as an example of a layer-forming unit is provided on the downstream side of the bottom end section of the application roll 120 in the rotation direction that is immersed in the liquid developer G in the storage tank 152. The regulatory blade 122 is made of a plate member having the rotation axis direction (Z direction) of the application roll 120 as the longitudinal direction, and a front end section 122A is disposed apart from the outer circumferential surface 120A of the application roll 120. In addition, the front end section regulates the amount of the liquid developer G passing through the gap between the front end section 122A of the regulatory blade 122 and the outer circumferential surface 120A of the application roll 120 so that a liquid developer layer GT is formed on the application roll 120.

A rotating body having the Z direction as the rotation axis direction is used as the development roll 110 as an example of the development member, and is rotated in the −R direction using a driving unit not shown. In addition, the development roll 110 has, for example, an elastic layer 114 having a semi-conductivity in a range of $1\times10^{5}$ Ω·cm to $1\times10^{10}$ Ω·cm on the surface of a metal core roll 112. In addition, a bias voltage is applied to the metal core roll 112.

In a contact section M in which the elastic layer 114 on the development roll 110 contacts the above-described application roll 120, the liquid developer layer GT that is held by the application roll 120 and formed by the regulatory blade 122 is applied onto the development roll 110, whereby a liquid developer layer GL is formed on the development roll 110. The elastic layer 114 on the development roll 110 contacts the photoreceptor 12, and a development nip section N (development section) is formed. In addition, in the development nip section N, the electrostatic latent image on the photoreceptor 12 is developed on the liquid developer layer GL (liquid developer G), and a toner image is formed.

The removing device 140 is configured to include a cleaning roll 142 and a cleaning blade 144.

A columnar rotating body having the Z direction as the rotation axis direction is used as the cleaning roll 142, and is disposed so as to contact the upstream side of the contact section M in the downstream of the development nip section N on the outer circumferential surface of the development roll 110. The residual liquid developer GC that is not developed in the development nip section N and remains is electrically attached and removed by applying a voltage to the cleaning roll 142.

The cleaning blade 144 is made of a plate member having the rotation axis direction (Z axis direction) of the cleaning roll 142 as the longitudinal direction, a front end section 144A contacts an outer circumferential surface 142A of the cleaning roll 142, and the residual liquid developer GC attached to the cleaning roll 142 is scraped and collected. The collected residual liquid developer GC is made to flow through a collection path S, and is returned to the storage tank 152 in the storage section 150. Meanwhile, the residual liquid developer GC removed and collected using the removing device 140 passes through a contact section T in the shearing device 200 described below, and then is returned to the storage tank 152 in the storage section 150.

Shearing Device

Next, the shearing device will be described.

The shearing device 200 is provided in the collection path S. The shearing device 200 includes a first roll 210 and a second roll 220. Columnar rotating bodies having the Z direction as the rotation axis direction respectively are used as the first roll 210 and the second roll 220. An outer circumferential section 214 made of an elastic body is provided around an axis section 212 of the first roll 210. In addition, the second roll 220 bites into the outer circumferential section 214, which is made of an elastic body, of the first roll 210 (not shown), thereby forming the contact section (nip section) T.

Meanwhile, the outer circumferential section 214 of the first roll 210 is made of an elastic body that shows neither absorption nor swelling in a solvent such as NBR rubber, urethane rubber, hydrin rubber, nitrile rubber, fluorine rubber, or polyimide rubber, an elastic body that shows absorption or swelling in a solvent such as silicon rubber, an elastic body such as urethane, hydrin, polyimide, or nitrile, a porous thermal-resistant elastic body having microcells on the surface (for example, a material made of PTFE, cellulose acetate, polycarbonate, or the like having a pore diameter in a range of 0.1 μm to 1 μm and a thickness in a range of 50 μm to 300 μm), or the like.

Meanwhile, the second roll 220 is made of a metallic material such as SUS or aluminum, or a resin material such as polypropylene, ABS, or polycarbonate.

Figure 2A:
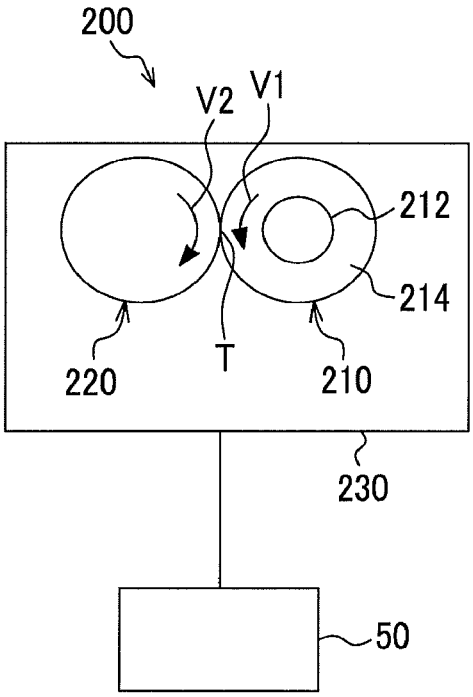
FIG. 2A is a schematic view schematically showing principal parts of a shearing device shown in FIG. 1.

As shown in FIG. 2A, the first roll 210 and the second roll 220 are configured to be independently rotated with each other using a driving device 230, and rotate so as to move in the same direction in the contact section T (rotate in the reverse direction to each other). In addition, the driving device 230 is controlled using the control section 50, and is controlled so that the circumferential velocity V1 of the first roll 210 in the contact section T becomes slower than the circumferential velocity V2 of the second roll 220. That is, the driving device is controlled to cause a circumferential velocity difference V3 (=V2−V1) between the first roll 210 and the second roll 220 in the contact section T.

As shown in FIG. 1, the residual liquid developer GC removed and collected using the removing device 140 passes through the contact section T in the shearing device 200 in which the circumferential velocity difference V3 is caused, and then is returned to the storage tank 152 in the storage section 150.

In the shearing device 200, both outer circumferential sections of the first roll 210 and the second roll 220 may be made of a non-elastic body such as a resin material such as polypropylene, ABS, or polycarbonate, or a metallic material such as SUS or aluminum, but a preferable aspect is that the outer circumferential section 214 of the first roll 210 is an elastic body and forms the nip section with the second roll 220.

Control by Control Section

Next, a part of the control by the control section 50 will be described.

In the image-forming apparatus 10 of the exemplary embodiment shown in FIG. 5, the rotation velocity (rotation number) of the photoreceptor 12, that is, the process velocity for forming a toner image on the recording medium P becomes variable. The control section 50 controls the exposure device 22 or the rotation velocities and the like of a variety of the rolls in the liquid development device 100 depending on the process velocity (the rotation velocity of the photoreceptor 12). Specifically, as the rotation velocity (process velocity) of the photoreceptor 12 becomes faster, the rotation velocities (rotation numbers) of the development roll 110, the application roll 120, the cleaning roll 142, and the first roll 210 and the second roll 220 in the shearing device 200 are increased.

Meanwhile, the shearing device 200 is controlled so that the circumferential velocity difference V3 between the first roll 210 and the second roll 220 in the contact section T falls into a predetermined range even when the rotation velocities of the first roll 210 and the second roll 220 are increased.

In addition, in the shearing device 200, the circumferential velocity difference V3 between the circumferential velocity V1 of the first roll 210 and the circumferential velocity V2 of the second roll 220 is controlled in accordance with the area coverage of the toner image formed on the recording medium P, in other words, the image density of the electrostatic latent image formed on the photoreceptor 12 using the exposure device 22. Specifically, as the image density of the electrostatic latent image on the photoreceptor 12 decreases, the circumferential velocity difference V3 between the circumferential velocity V1 of the first roll 210 and the circumferential velocity V2 of the second roll 220 is controlled to increase.

Meanwhile, the area coverage (image density) may be obtained using any method. For example, the area coverage (image density) of the toner image formed on the recording medium P may be obtained based on image data scanned using a scanner 60, or the area coverage may be obtained based on an image information exposed by the exposure device 22. Furthermore, the circumferential velocity difference V3 may be controlled base on image data obtained by scanning the toner image formed on the recording medium P using the scanner 60, or the circumferential velocity difference V3 may be controlled based on image information exposed by the exposure device 22.

Action and Effect

Next, the action and effect of the exemplary embodiment will be described.

The residual liquid developer GC remaining on the development roll 110 after the electrostatic latent image on the photoreceptor 12 is developed and the toner image is formed obtains a high concentration and a high viscosity due to decrease in the carrier liquid component. Therefore, in the residual liquid developer GC, there is a case in which a toner aggregate in which the toner is aggregated is generated.

In the exemplary embodiment, the residual liquid developer GC removed and collected using the removing device 140 passes through the contact section T between the first roll 210 and the second roll 220 in the shearing device 200, and then is returned to the storage tank 152 in the storage section 150.

The circumferential velocity V1 of the first roll 210 is controlled to become slower than the circumferential velocity V2 of the second roll 220, and it is controlled to cause the circumferential velocity difference V3 (=V2−V1) between the first roll 210 and the second roll 220 in the contact section T. Therefore, when the residual liquid developer GC passes through the contact section T, a shear force is applied to the toner aggregate, and the toner aggregate is ground. Therefore, the toner aggregate in the residual liquid developer GC that has been removed from the development roll 110 and returned to the storage tank 152 in the storage section 150 is reduced or removed. In other words, the incorporation of the toner aggregate into the storage tank 152 in the storage section 150 is suppressed or prevented.

Here, in a case in which the toner aggregate is incorporated into the storage tank 152 in the storage section 150, the toner aggregate incorporates into the liquid developer G supplied to the development roll 110 from the application roll 120. The toner aggregate that has incorporated into the liquid developer G on the development roll 110, ultimately, incorporates into the toner image formed on the recording medium P, and the image quality degrades.

In addition, when the toner aggregate incorporates into the liquid developer G in the concentration control tank 154, the concentration of the toner in the liquid developer G becomes high in some places, and the measurement accuracy of the toner concentration by the concentration sensor 156 decreases. In addition, when the measurement accuracy of the toner concentration in the liquid developer G decreases, the concentration of the toner in the liquid developer G varies, and the image quality degrades.

However, in the exemplary embodiment, since the toner aggregate is ground by applying a shear force using the shearing device 200, and is returned to the storage tank 152 in the storage section 150 as described above, the above-described degradation of the image quality is prevented or suppressed.

In addition, in the exemplary embodiment, the second roll 220 in the shearing device 200 bites into the outer circumferential section 214 of the first roll 210, which is made of an elastic body, thereby forming the contact section (nip section) T. When the outer circumferential section 214 of the first roll 210 is made of an elastic body as described above, the width of the contact section T (nip width) increases, and a shear force is applied to the toner aggregate in the residual liquid developer GC over a long period of time. Therefore, the effect that grinds and dissolves away the toner aggregate in the residual liquid developer GC improves.

In addition, when the process velocity increases, the rotation velocity of the development roll 110 increases, and accordingly, the collection amount of the residual liquid developer GC increases. In addition, the rotation velocities of the first roll 210 and the second roll 220 in the shearing device 200 are increased using the control section 50, and the amount of the residual liquid developer returned to the storage tank 152 in the storage section 150 is ensured.

Meanwhile, since the control section 50 controls the circumferential velocity difference V3 between the first roll 210 and the second roll 220 in the contact section T of the shearing device 200 to fall into a predetermined range, the temperature increase of the residual liquid developer GC due to an increase in the shear force (increase in the circumferential velocity difference V3) in the contact section T is suppressed. Therefore, a change in the quality caused by the temperature increase of the residual liquid developer GC when passing through the contact section T is suppressed (the returning of the modified residual liquid developer GC to the storage tank 152 in the storage section 150 is prevented). That is, the amount of the residual liquid developer returned to the storage tank 152 in the storage section 150 is ensured, the toner aggregate is reduced, and furthermore, a change in the quality caused by the temperature increase of the residual liquid developer GC in the contact section T is suppressed.

In addition, when the area coverage of the toner image, in other words, the image density of the electrostatic latent image formed on the photoreceptor 12 using the exposure device 22 is small, the consumption amount of the toner is small, and therefore the concentration of the toner in the residual liquid developer GC increases. Therefore, the toner aggregate is often generated in the residual liquid developer GC, and the cohesive force of the toner aggregate is likely to increase.

Therefore, in the exemplary embodiment, in the shearing device 200, the circumferential velocity difference V3 between the circumferential velocity V1 of the first roll 210 and the circumferential velocity V2 of the second roll 220 is controlled using the control section 50 depending on the area coverage of the toner image formed on the recording medium P (the image density of the electrostatic latent image formed on the photoreceptor 12 using the exposure device 22).

Specifically, as the image density of the electrostatic latent image on the photoreceptor 12 decreases, that is, as the toner aggregate in the residual liquid developer GC is more often generated, and the cohesive force of the toner aggregate increases, the circumferential velocity difference V3 between the circumferential velocity V1 of the first roll 210 and the circumferential velocity V2 of the second roll 220 is increased. Therefore, the toner aggregate in the residual liquid developer GC is effectively dissolved away.

MODIFICATION EXAMPLES

Next, modification examples of the shearing device 200 will be described.

First Modification Example

Figure 2B:
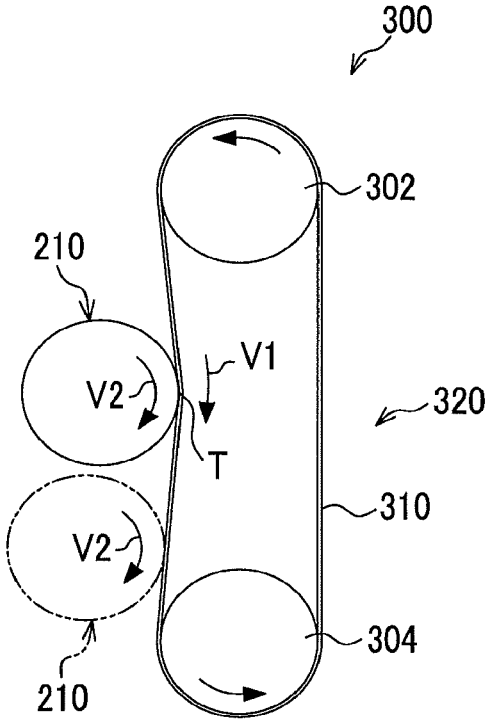
FIG. 2B is a schematic view schematically showing principal parts of a shearing device of a first modification example.

A shearing device 300 of a first modification example shown in FIG. 2B includes a belt mechanism 320 in which a belt member 310 is wound around a driving roll 302 and a driven roll 304, and the belt member 310 is moved around. In addition, the first roll 210 contacts and bites into the belt member 310 in the belt mechanism 320, thereby forming the contact section T.

The first roll 210 and the belt member 310 in the belt mechanism 320 are controlled using the control section 50 (refer to FIGS. 1 and 5), the first roll and the belt member move in the same direction in the contact section T respectively, and are controlled to cause a circumferential velocity difference V3 (=V2−V1) between the first roll 210 and the belt member 310.

Meanwhile, plural first rolls 210 may be provided as shown using an imaginary line (two-dotted broken line) in the drawing.

Second Modification Example

Figure 3A:
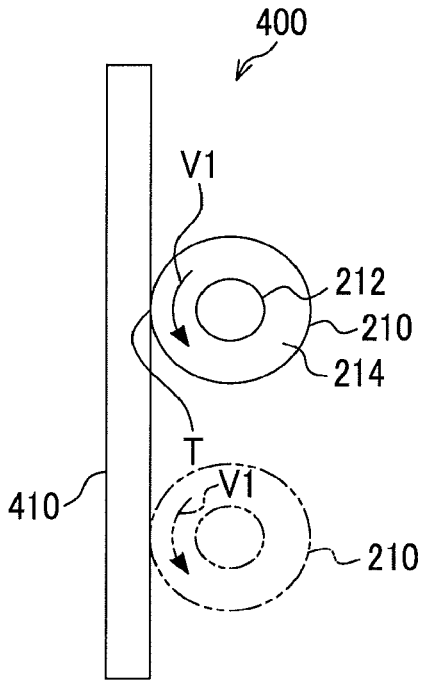
FIG. 3A is a schematic view schematically showing principal parts of a shearing device of a second modification example.

In a shearing device 400 of a second modification example shown in FIG. 3(A), the first roll 210 contacts and bites into a plate fixing member 410, thereby forming the contact section T. Meanwhile, in this case, the fixing member 410 is not movable, and therefore the circumferential velocity V1 of the first roll 210 becomes the circumferential velocity difference V3 (=V1).

Meanwhile, plural first rolls 210 may be provided as shown using an imaginary line (two-dotted broken line) in the drawing. In addition, the fixing member 410 may be curved.

Third Modification Example

Figure 3B:
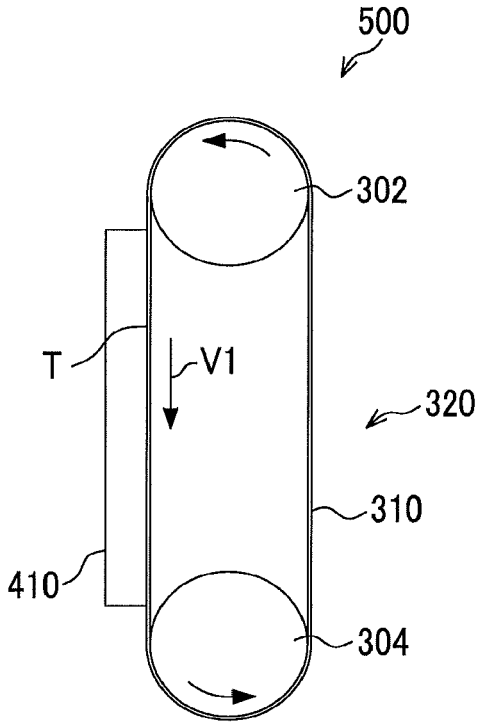
FIG. 3B is a schematic view schematically showing principal parts of a shearing device of a third modification example.

In a shearing device 500 of a third modification example shown in FIG. 3(B), the belt member 310 in the belt mechanism 320 contacts the plate fixing member 410, thereby forming the contact section T. Meanwhile, in this case, the fixing member 410 is not movable, and therefore the circumferential velocity V1 of the belt member 310 in the belt mechanism 320 becomes the circumferential velocity difference V3 (=V1). In addition, the fixing member 410 may be curved.

Fourth Modification Example

Figure 4:
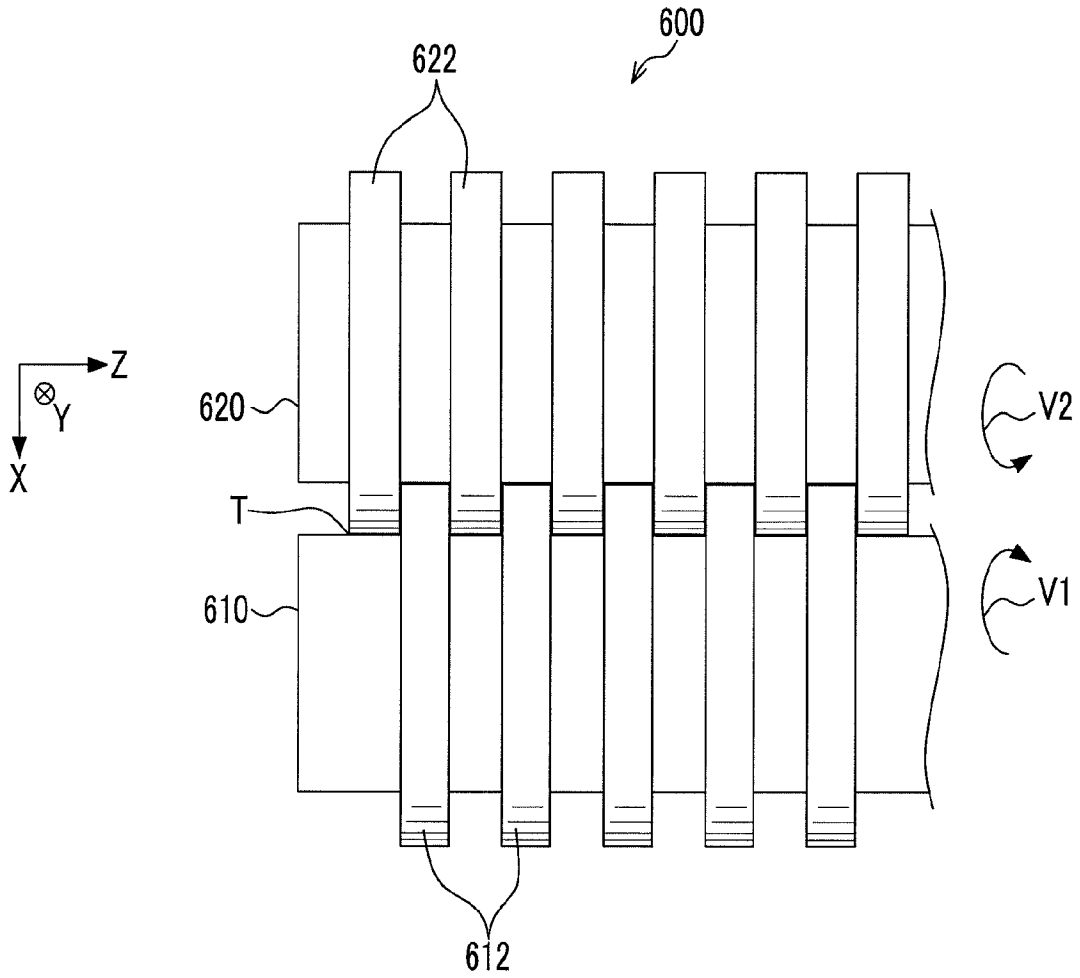
FIG. 4 is a schematic plan view of principal parts of a shearing device of a fourth modification example.

A shearing device 600 of a fourth modification example shown in FIG. 4 includes a first roll 610 and a second roll 620. The first roll 610 and the second roll 620 have a protrusion section 612 and a protrusion section 622, which protrude toward the outside of the radial direction, on the circumferential surfaces respectively. In addition, the protrusion section 612 and the protrusion section 622 are alternately disposed in the axial direction, and engage with each other. Therefore, the contact area increases in the contact section T, and many toner aggregates may be ground by applying a shear force. Therefore, the effect that grinds and dissolves away the toner aggregate in the residual liquid developer GC improves.

Others

Furthermore, the invention is not limited to the above-described exemplary embodiments.

For example, in the above-described exemplary embodiments, the circumferential velocity difference V3 between the first roll 210 and the second roll 220 in the contact section T is controlled to fall into a predetermined range, but the circumferential velocity difference is not limited thereto. The circumferential velocity difference V3 may be controlled not to exceed the predetermined threshold value.

In addition, for example, in the above-described exemplary embodiments, the outer circumferential section 214 of the first roll 210 in the shearing device 200 is made of an elastic body, but the configuration is not limited thereto. The outer circumferential section of the second roll 220 may be made of an elastic body, and both outer circumferential sections of the first roll and the second roll may be made of an elastic body. Furthermore, both outer circumferential sections of the first roll and the second roll may be made of a non-elastic body such as a resin material such as polypropylene, ABS, or polycarbonate, or a metallic material such as SUS or aluminum. In addition, the plate member 420 in the modification examples may be made of an elastic body.

In addition, for example, in the above-described exemplary embodiments, the first roll 210 and the second roll 220, and the belt member 310 and the second roll 220 move in the same direction (reversely rotate) in the contact section T, but the configuration is not limited thereto. The first roll and the second roll, and the belt member and the second roll may move in the reverse direction (rotate in the same direction).

In addition, for example, in the above-described exemplary embodiments, one shearing device is provided in the collection path S, but the configuration is not limited thereto. Plural shearing devices may be provided in the collection path S. That is, the residual liquid developer GC may be returned to the storage tank 152 in the storage section 150 by further grinding the residual liquid developer GC ground by applying a shear force to the toner aggregate using the shearing device on the upstream side in the collection path S by applying a shear force to the toner aggregate using the shearing device on the downstream side.

In addition, at this time, the shearing device having different structures in the above-described exemplary embodiments and the modification examples may be combined.

In addition, the configuration of the image-forming apparatus is not limited to the configurations of the above-described exemplary embodiments, and a variety of configurations may be employed.

Furthermore, it is needless to say that the invention may be carried out in various aspects without departing from the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid development device comprising:

a storage section storing a liquid developer in which toner is dispersed;

a development member to which the liquid developer stored in the storage section is applied using an application unit;

a removing device that, after an electrostatic latent image in a latent image-holding member is developed, removes the liquid developer remaining on the development member; and a shearing device that is provided in a path through which the liquid developer removed using the removing device is returned to the storage section, and applies a shear force to the liquid developer removed using the removing device by making the liquid developer pass through a contact section of two members at least one of which rotates and that have different velocities from each other, wherein the contact section of two members is one selected from the group consisting of:

(a) a first roll that contacts and bites into a plate fixing member such that the liquid developer is removed from the first roll and the plate fixing member as the liquid developer exits a contact point between the first roll and the plate fixing member, and the removed liquid developer is returned to the storage section; and (b) a belt member in a belt mechanism that contacts a plate fixing member, wherein the plate fixing member consists of a solid plate and the belt member directly contacts the solid plate.

2. The liquid development device according to claim 1, wherein the contact section of two members is the first roll that contacts and bites into the plate fixing member.

3. The liquid development device according to claim 1, wherein the contact section of two members is the belt member in the belt mechanism that contacts the plate fixing member.

4. The liquid development device according to claim 1, wherein the shearing device is located entirely outside of the storage section.

5. The liquid development device according to claim 1, wherein the removing device includes a cleaning member to which the liquid developer remaining on the development member after an electrostatic latent image in a latent image-holding member is developed is transferred and a cleaning blade that removes the liquid developer from a surface of the cleaning member.

6. An image-forming apparatus comprising:

a latent image-holding member that holds an electrostatic latent image;

the liquid development device according to claim 1 that develops the electrostatic latent image on the latent image-holding member using a liquid developer applied to a development member, and forms a developer image on the latent image-holding member;

a transfer unit that transfers the developer image formed on the latent image-holding member to a recording medium; and a fixing unit that fixes the developer image transferred to the recording medium to the recording medium.

* * * * *